United States Patent [19]

Pinto et al.

[11] Patent Number: 4,888,857

[45] Date of Patent: Dec. 26, 1989

[54] APPARATUS FOR REMOVING FIBER MATERIAL ACCUMULATIONS, IN PARTICULAR FROM BALES OF SPINNING MATERIAL

[75] Inventors: Akiva Pinto, Duesseldorf; Guenter Lucassen, Haltern; Reinhard Schmidt, Gescher, all of Fed. Rep. of Germany

[73] Assignee: Hergeth Hollingsworth GmbH, Duelman, Fed. Rep. of Germany

[21] Appl. No.: 240,980

[22] Filed: Sep. 6, 1988

[30] Foreign Application Priority Data

Sep. 11, 1987 [DE] Fed. Rep. of Germany ..... 3730487

[51] Int. Cl.[4] ..... D01G 7/06

[52] U.S. Cl. ..... 19/80 R; 19/81

[58] Field of Search ..... 19/80 R, 82, 97, 97.5, 19/64.5, 81

[56] References Cited

U.S. PATENT DOCUMENTS

| | | | |
|---|---|---|---|
| 3,736,624 | 6/1973 | Alt et al. | 19/80 R |
| 4,057,876 | 11/1977 | Sawyer | 19/80 R |
| 4,377,021 | 3/1983 | Peters | 19/80 R |
| 4,446,602 | 5/1984 | Marx et al. | 19/80 R X |
| 4,514,881 | 5/1985 | Hergeth et al. | 19/81 X |
| 4,712,275 | 12/1987 | Hosel et al. | 19/80 R |
| 4,771,513 | 9/1988 | Pinto | 19/80 R |

*Primary Examiner*—Donald Watkins

*Attorney, Agent, or Firm*—Cort Flint

[57] ABSTRACT

A textile fiber opening and removing apparatus (1) is disclosed having a tower (2) wherein at least one cantilevered arm (5, 6) is supported on the tower in such a manner that the cantilevered arm rotates about a longitudinal axis of the tower and a central axis (31) of a fiber discharge section (11) to various angles. Control means (35) mutually controls and coordinates a lift motor (24) and a traction motor (28) to move cantilevered arm (5) and milling unit (7) over a prescribed inclined path. In this manner, fiber bales (4) may be continuously fed at the top of the inclined path for fiber removal.

10 Claims, 3 Drawing Sheets

APPARATUS FOR REMOVING FIBER MATERIAL ACCUMULATIONS, IN PARTICULAR FROM BALES OF SPINNING MATERIAL

BACKGROUND OF THE INVENTION

The invention relates to an apparatus for removing fiber material, in particular from bales of spinning material, e.g. cotton, synthetic fibers etc. from the top side of the fiber bale for producing a mixture by means of milling means and the like. A tower reciprocates with the aid of a carriage on guide rails along the fiber material. The tower comprises at least one cantilevered arm extending transversely to the travel direction having a fiber removing means, preferably a milling unit. The cantilevered arm is movable in height along the tower. The opened fibers or flocks are discharged by suction air current.

Fiber bale opening and removal apparatus of the above mentioned type have been known. However, the row of bales may be reduced, only in one horizontal plane. As a result, it is necessary to first completely reduce the bale setup to the bottom by reciprocating the tower with the cantilevered arm before a new bale setup may be prepared. The reciprocating tower is frequently provided with two cantilevered arms having a milling unit, or the tower with a single cantilevered arm may be rotated by 180 degrees about its vertical axis. While the fiber bales on one side of the tower are reduced by the milling unit, bales may be set up on the other side of the tower. Upon the reduction of the fiber material on one side, the same operation may be performed on the other side of the tower. By this means, no time is lost and the reducing means may be practically operated without interruption.

There has also been known bale opening apparatus in which bales may be advanced longitudinally and added to the bale row being worked down. For this purpose, the fiber opening device may move along an inclination relative to the bale row. The opening device is displaced in height on 10 guides, rails, etc. obliquely extending along the row of bales. The fiber material is worked down along an ascending or descending inclination of a predetermined extend. From the highest point of the inclination, new bales may be continuously added. The angle size of the inclination is generally fixed. In special case, the total inclination may be changed.

It is an object of the invention to provide fiber opening and removing apparatus which works down the fiber material in the row of bales and the like under various oblique angles during the processing.

SUMMARY OF THE INVENTION

The above objectives are accomplished according to the invention by providing a cantilevered arm together with a milling unit which is rotatably supported by a reciprocating tower and adjustable at various angles relative to the longitudinal axis of the tower. As a result, a fiber milling unit for removing the fiber material from a row of bales and the like is provided in which the angle of inclination of the processing plane may be changed by simple means. The inclined position of the milling unit may be quickly and reliably altered during the to and from movement along the row of bales. Hence, the removal may be adapted individually to the type and setup of the fiber material. The slope of the milling head may be adjusted more or less relative to the lo setup plane, while working in the horizontal plane is still possible. The angle change of the milling head may be performed upon a forward and return travel, subject to the kind of fiber material. The milling operation for the fiber material may be easily and quickly adapted to the prevailing conditions. It is possible to conventionally work down a bale row, but subject to specific necessities, the fiber material may be also processed vertically.

According to another feature of the invention, the cantilevered arm containing the milling unit is rotatably supported about a central axis of a material discharge channel between the cantilevered arm and tower. The cantilevered arm may be also mounted to be rotatable about the point of intersection between the central longitudinal axis of the milling unit and a lower boundary face of the cantilevered arm. The angle of rotation of the cantilevered arm in one sense or the other may be variable. Preferably, the cantilevered arm carrying the milling unit should be rotatable within 180 degrees in one sense of rotation and/or the other and it should be lockable. Thus, with a corresponding arrangement, the fiber material may be reduced from below.

In view of the proposed rotation, there may be provided between the cantilevered arm and the tower or the holding portion for the cantilevered arm fixed to the tower, an internal gear meshing with the toothed gear connected to the cantilevered arm. Further, within the cantilevered arm, a driving gear motor may be connected to the shaft of the toothed gear.

Generally, in case of the tower carrying the cantilevered arm, the weight of the latter is compensated at least partly via a tackle line and a counterweight. The cantilevered arm may be shifted in height by means of a lifting motor. For fiber milling along an inclination, the displacement path of the cantilevered arm in height direction by the lifting motor and the longitudinal movement of the tower by the traction motor are to be mutually coordinated by means of a control unit to provide a predetermined angle position of the cantilevered arm.

In connection with fiber opening apparatus provided with a reciprocating tower, rotatability of the milling unit at the tower allows to continuously push forward new bales being added to the existing bale row thus ensuring that the milling unit may operate effectively without interruption.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
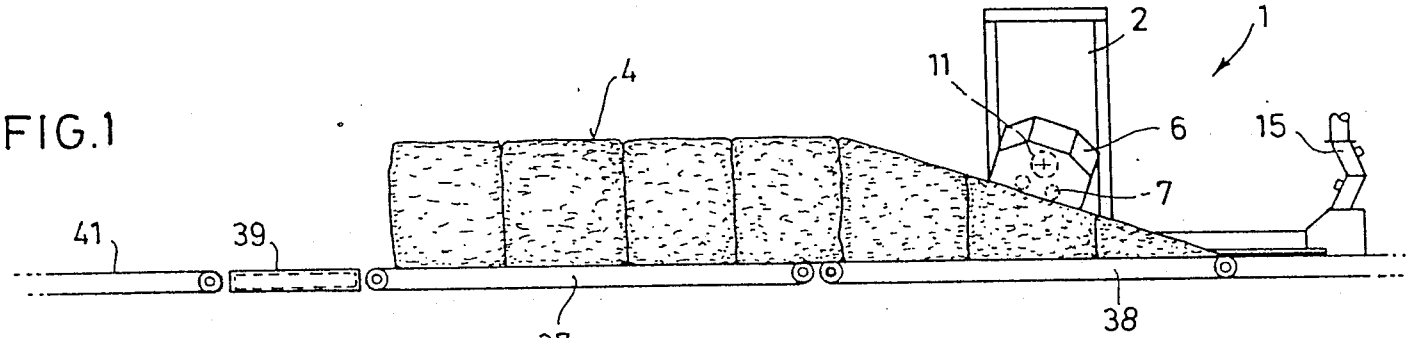
FIG. 1 shows a schematic elevational view of a fiber material opening and removal apparatus having a tower-milling unit according to the invention.

Fiber opening and removed apparatus, designated generally as 1, comprises a tower 2 adapted to reciprocate along rails 3 parallel to a base setup 4 over a predetermined path. At one or both sides of the tower 2, a cantilevered arm 5, 6 is connected to the tower which comprises a milling means 7 which may consist of one milling roller or of two oppositely moving milling rollers. The cantilevered arm 5, 6 is integrally mounted to a holder 9 connected to the tower. 10 The fiber material worked down by the milling unit 7 is discharged by a suction current. Inside the cantilevered arm 5, 6 a channel 10 communicates with a duct section 11 in the holder 9 from where the suction current flows through a channel 12 and a flexible hose 13. Flexible hose 13 is adjustable in height. The current then flows to a suction channel 14 arranged between the rails 3 and from there, at the end, through a pneumatic line 15.

Each cantilevered arm 5, 6 and associated milling means 7 may be adjustably positioned in height at the tower 2. The holder carrying the cantilevered arm 5, 6 is suspended via a cable 17, 18 and guide rollers 19, 20 and counterweights 21, 22. Lifting motors 23, 24 provide independent height adjustment of the cantilevered arms 5, 6 by transmission members 25, 26 and guide rollers 19, 20. A traction motor 28 is provided for the tower wheels 29 resting on rails 3.

In case of the illustrated embodiment, support means is disclosed for rotatably carrying the cantilevered arms 5, 6 and the milling unit 7 on tower 2. The rotatability of the cantilevered arm is provided about a center axis 31 of the material discharge section 11 in the holder 9 of the tower 2. Between the holder 9 and the cantilevered arms 5, 6 there may be provided an internal gear 32 connected to the cantilevered arm meshing with a gear 33.

A driving gear motor 34 is carried in the cantilevered arm 5, 6 and shaft 34*a* of the motor is nonrotatingly connected to gear 33.

It is possible to rotate cantilevered arms 5, 6 relative to tower 2 in any desired sense thus enabling the cantilevered arm and the milling means to take a predetermined inclined position relative to the fiber material accumulation or the bale row. Preferably, the pivot angle from the horizontal line in one direction or the other is up to 180 degrees. In special cases, the cantilevered arm may be rotated through 360 degrees with respect to the tower. By this means, a row of bales may be reduced by the tower milling head along an inclination at a predetermined angle, and variable changes of the rotatable milling head may be performed during the processing operations. The angle variations of the milling unit during a reciprocating movement of the tower may be realized discontinuously and in adaptation to the situations prevailing with respect to the bale setup. Accordingly, an individual reduction may be reliably performed by simple means. The inclination for the reducing operation may be optionally selected to be steep or flat.

Figure 2:
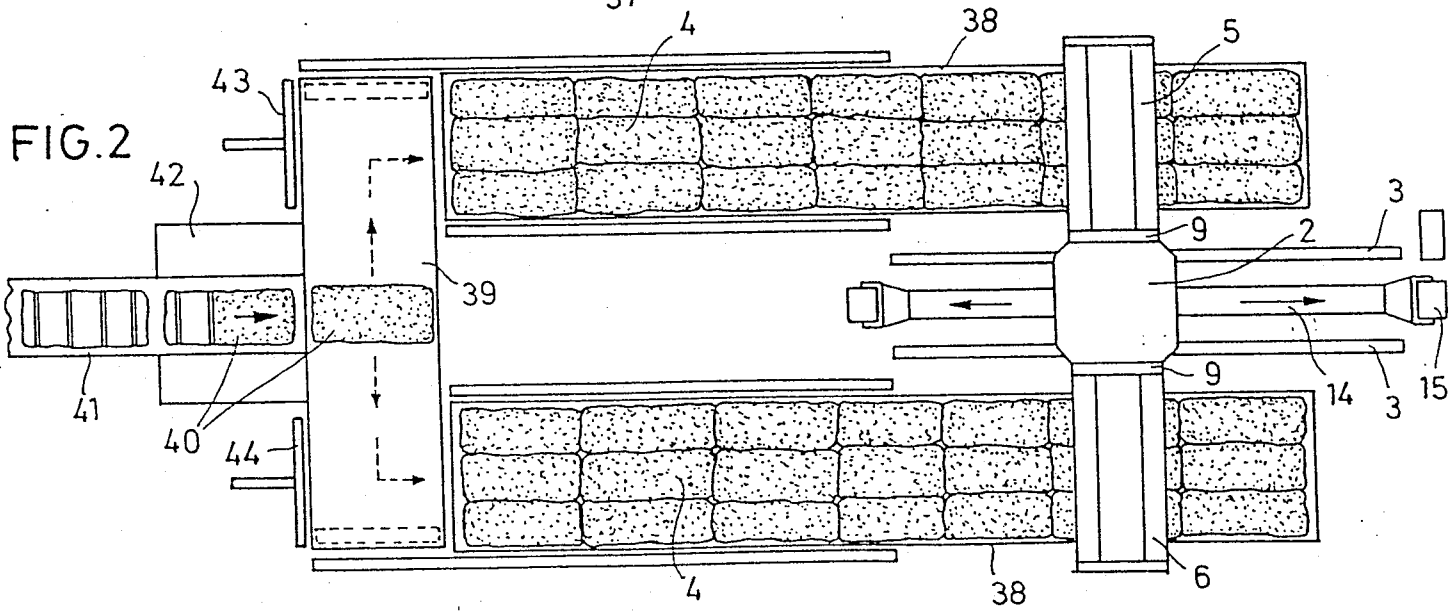
FIG. 2 is a plan view of the fiber material opening and removal apparatus having a tower-milling unit of FIG. 1.
Figure 3:
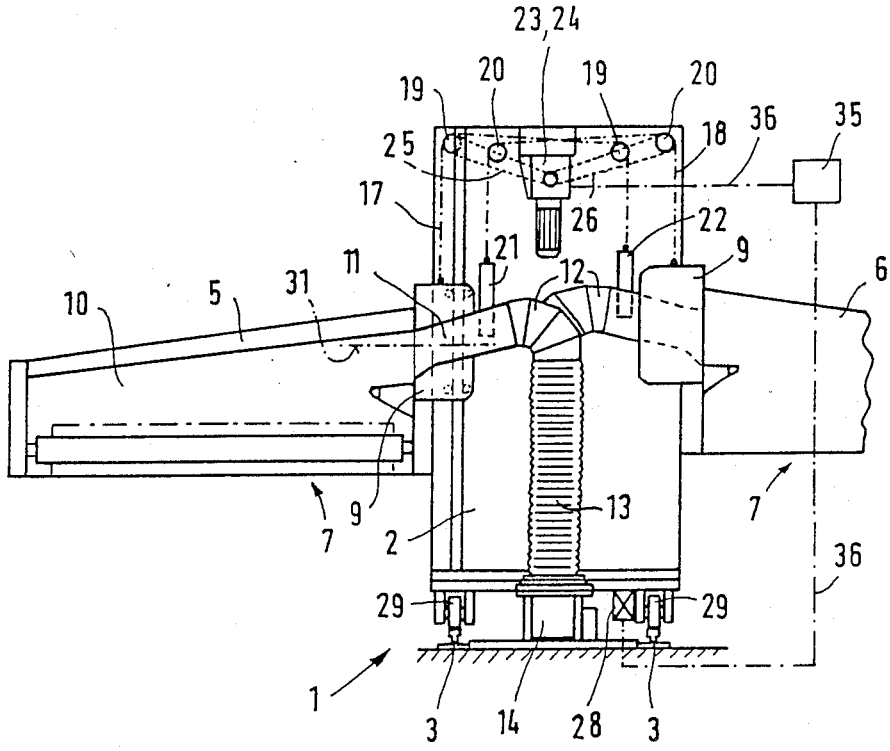
FIG. 3 is a cross section of the fiber material opening and removal apparatus having a tower-milling unit of FIGS. 1 and 2.
Figure 4:
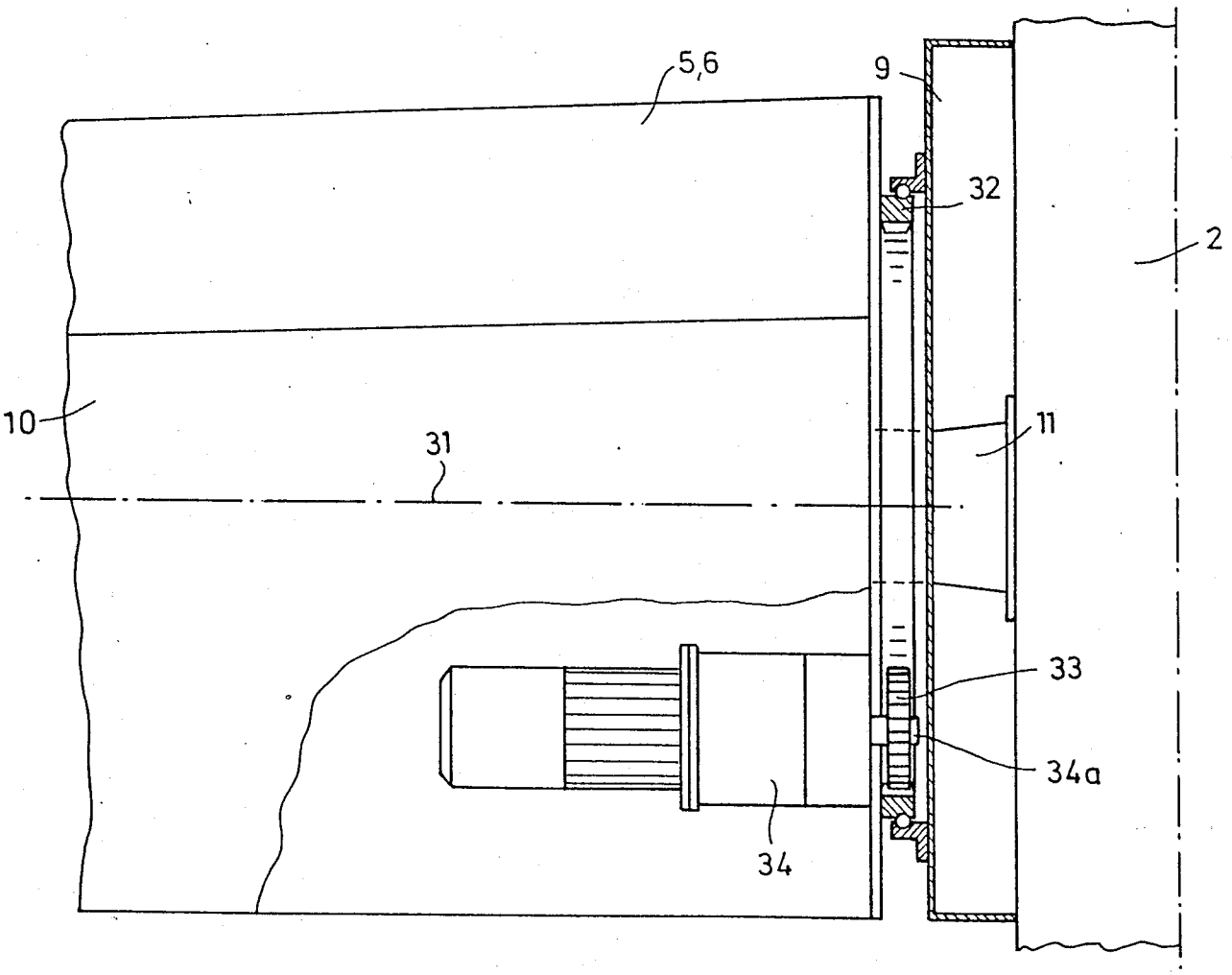
FIG. 4 illustrates fiber material opening and removal apparatus having a rotatable cantilevered arm and milling unit carried by the tower.

Due to the rotatable milling head at the tower of a fiber removal apparatus, the reduction of the row of bales 10 may be achieved continuously in that the bale row is constantly supplemented at its free end, as can best be seen in FIG. 2. The bale row 4 or setup rests on conveyer belts 37, 38 by which it is advanced towards the rotatable milling head 6, 7. At the end of the bale row or rows 4, a transversely extending conveyer belt 39 is arranged for new bales 40 being shifted thereon by another conveyer belt 41. In advance of the transverse belt 39, there may be provided a waste disposal station 42 for the removal of the packing or the like. The respective new bale 40 will be then immediately pushed forward behind one bale row or the other 4 as far as to the desired position, whereupon, by a ram device 43 or 44, it may be shifted onto the subsequent belt 38. Hence, a constant supply of fresh bales being added to row bale 4 is ensured, thus permitted a continuous working or the tower-removing unit 2, 5, 6.

While a preferred embodiment of the invention has been described using specific terms, such description is for illustrative purposes only, and it is to be understood that changes and variations may be made without departing from the spirit or scope of the following claims.

What is claimed is:

1. Apparatus for removing textile fiber material from bales of spinning material and the like of the type having a tower which reciprocates with a carriage on guide rails along the fiber material, said tower comprising at least one cantilevered arm extending transversely to the travel direction and including a milling means for removing fiber material, said cantilevered arm and said milling means being displaceable along a height of said tower and the removed fiber material is discharged by a suction air current, characterized in that said apparatus includes support means for rotatably carrying said cantilevered arm and said milling means on said tower and adjusting the angular position of said cantilevered arm with respect to said tower so that said cantilevered arm and milling means are adjustable to various angles relative to a longitudinal axis of said tower.

2. The apparatus of claim 1 including a material discharge section between said cantilevered arm and tower through which said fiber material is removed by said air current, and said cantilever arm is rotatable about a central axis of said discharge section.

3. The apparatus of claim 1 wherein said cantilevered arm accommodating said milling means is rotatable up to 180 degrees in opposing directions of rotation.

4. The apparatus of claim 1 wherein said support means includes a first gear carried by said cantilevered arm and a second gear meshing with said first gear in a drive relation for rotating said cantilevered arm at said tower.

5. The apparatus of claim 4 including a driving motor arranged at said cantilevered arm having a motor shaft nonrotatingly connected to said second gear.

6. The apparatus of claim 1 of the type including a tackle line and a counterweight for compensating for the weight of said cantilevered arm, said cantilevered arm being displaceable in height by a lifting motor, and including control means for mutually coordinating a displacement of said cantilevered arm along said height by said lifting motor and a longitudinal movement of said tower by the traction motor.

7. The apparatus of claim 1 including a lift motor for raising and lowering said cantilevered arm generally in a vertical direction along a height of said tower, a traction motor for moving said tower and carriage longitudinally on said guide rails, and a control means for mutually controlling and coordinating said lift and traction motors to move said cantilevered arm and milling unit in a prescribed inclined path.

8. The apparatus of claim 1 including a first conveying means arranged beside the path of said reciprocating tower for conveying the fiber material, and a second transversely extending conveying means arranged transverse at the beginning to said first conveying means to which new bales are fed by a supply means.

9. Apparatus for removing textile fiber material from fiber material accumulations such as fiber bales and the like comprising:

a tower which reciprocates in opposing longitudinal directions;

motor means for moving said tower in said longitudinal direction;

at least one cantilevered arm carried by said tower extending transversely to said longitudinal direction which includes a milling means for removing fiber material from said fiber material accumulation;

displacement means for displacing said cantilevered arm vertically along a height of said tower;

means for discharging fiber material removed from said fiber material accumulation in an air current;

support means for rotatably carrying said cantilevered arm on said tower and adjusting the angular position of said cantilevered arm with respect to said tower so that said cantilevered arm and milling means are adjustable to various angles relative to a longitudinal axis of said tower; and control means for mutually controlling and coordinating said motor means and said displacement means to move said cantilevered arm and milling unit in a prescribed inclined path over said fiber material accumulations.

10. The apparatus of claim 9 wherein said fiber material accumulation include bales of said textile fibers, said inclined path includes a high point, and including means for continuously supplying fiber bales to said high point of said inclined path so that said fibers are continuously supplied to said milling means.

* * * * *